United States Patent [19]

Löhr et al.

[11] 4,189,995

[45] Feb. 26, 1980

[54] APPARATUS FOR HEATING FOOD

[75] Inventors: Alfred Löhr, Bochum; Günter Winterhoff, Dortmund; Wolfgang Tschek, Seiwerath, all of Fed. Rep. of Germany

[73] Assignee: Küppersbusch Aktiengesellschaft, Gelsenkirchen, Fed. Rep. of Germany

[21] Appl. No.: 936,520

[22] Filed: Aug. 24, 1978

[30] Foreign Application Priority Data

Aug. 31, 1977 [DE] Fed. Rep. of Germany ..... 2739198

[51] Int. Cl.[2] ..... F24H 3/04

[52] U.S. Cl. ..... 99/447; 99/417; 99/448; 99/473; 99/475; 126/21 A; 426/524

[58] Field of Search ..... 99/447, 448, 473, 474, 99/475, 480, 417, 418, 410; 426/524; 126/21 A, 273 R

[56] References Cited

U.S. PATENT DOCUMENTS

| | | | |
|---|---|---|---|
| 2,490,076 | 12/1949 | Maxson | 99/447 X |
| 2,636,969 | 4/1953 | Lewis | 99/447 X |
| 2,906,620 | 9/1959 | Jung | 426/524 |
| 3,295,434 | 1/1967 | Wilhelm et al. | 99/447 X |
| 3,827,346 | 8/1974 | Tropp et al. | 99/447 X |
| 3,926,106 | 12/1975 | Deusing et al. | 99/447 |
| 4,068,572 | 1/1978 | Vogt | 99/447 |

FOREIGN PATENT DOCUMENTS

| | | | |
|---|---|---|---|
| 1492542 | 9/1969 | Fed. Rep. of Germany | 99/447 |

*Primary Examiner*—Stanley N. Gilreath
*Attorney, Agent, or Firm*—Spencer & Kaye

[57] ABSTRACT

An apparatus for heating food includes a treating chamber, a multilevel shelving in the treating chamber for supporting the food to be heated; a plurality of blowers arranged in the treating chamber; and heating elements associated with the blowers for generating hot air currents. All the blowers are arranged in a vertically spaced, superposed relationship at one side of the treating chamber and an arrangement is provided for directing the air currents generated by each blower towards another, opposite side of the treating chamber.

2 Claims, 2 Drawing Figures

APPARATUS FOR HEATING FOOD

BACKGROUND OF THE INVENTION

This invention relates to an apparatus for the heat treatment (heating or cooking) of food, including, in a treating (heating) chamber, a multilevel shelving for supporting the food and a plurality of blowers associated with electric heater elements.

A known apparatus of the above-outlined type is disclosed in U.S. Pat. No. 2,906,620, issued Sept. 29, 1959. In the apparatus described therein, there are provided two hot air blowers arranged at opposite lateral walls of the treating chamber. An economical heating of food with an apparatus of this type is, however, possible only if all the shelves are stacked with the food material to be heated, since, due to the facing blowers, the hot air is at all times driven through the entire space of the treating chamber. Further, both blowers have to be operated at all times with the same rpm in order to ensure a uniform exposure of all shelves to the hot air.

SUMMARY OF THE INVENTION

It is an object of the invention to provide an improved apparatus of the above-outlined type which is of increased versatility regarding operational possibilities and further, it makes possible a rational and gentle preparation of food.

This object and others to become apparent as the specification progresses, are accomplished by the invention, according to which, briefly stated, the blowers are arranged at the same side of the treating chamber in a spaced, superposed relationship with respect to one another and the air currents generated by the blowers are guided in such a manner that air streams are formed which are directed towards the opposite sides of the treating chamber.

By means of the measure according to the invention as defined above, each food shelf is supplied directly with air by its own blower; in this manner the heating process is, in its entirety, accelerated and may be adapted to the particular food stuff on the respective shelves.

In accordance with a further feature of the invention, the individual blowers are driven independently from one another and thus can be rotated with different rpm's. It is a significant advantage of such an arrangement that each shelf may support a different kind of food stuff and a simultaneous heat treatment thereof is feasible with the respective air current adapted thereto.

In accordance with a further advantageous feature of the invention, in the bottom zone of the chamber a water-filled basin is provided which serves as a vapor generator. In this manner, the hot air currents generated by the individual, heater-equipped blowers carry with them water vapor to the food stuff. This measure then assures that an excessive drying of certain food stuffs is prevented during the heating and thus a particularly gentle preparation of the food stuff is ensured. Advantageously, the apparatus is so designed that air circulation can be maintained even if the blower heaters are shut off and only the water heater remains energized.

DESCRIPTION OF THE PREFERRED EMBODIMENT

Figure 1:
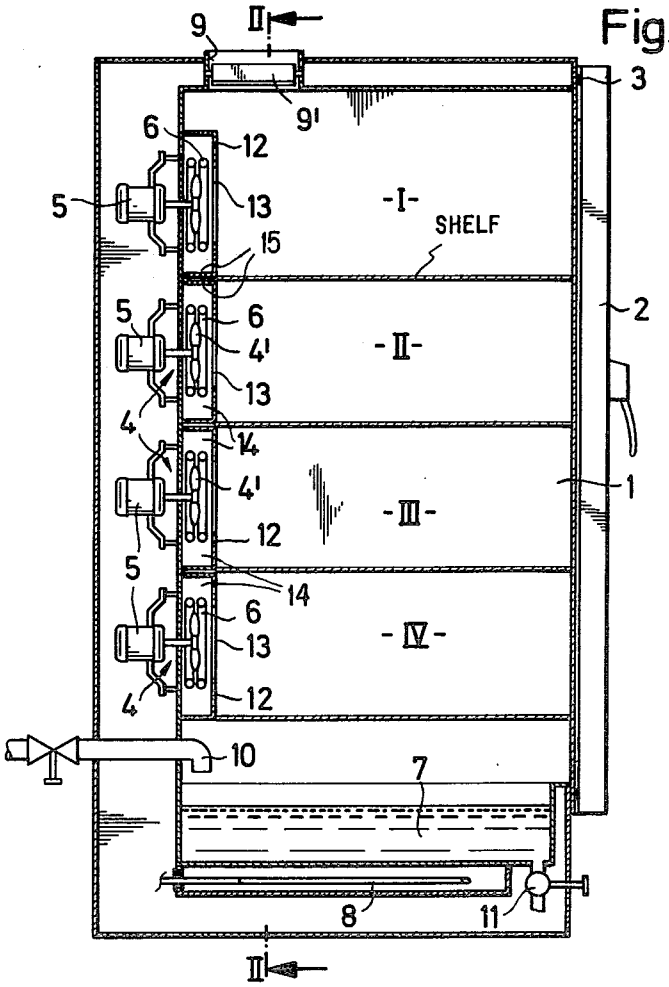
FIG. 1 is a schematic side elevational section of a preferred embodiment of the invention taken along line I—I of FIG. 2.
Figure 2:
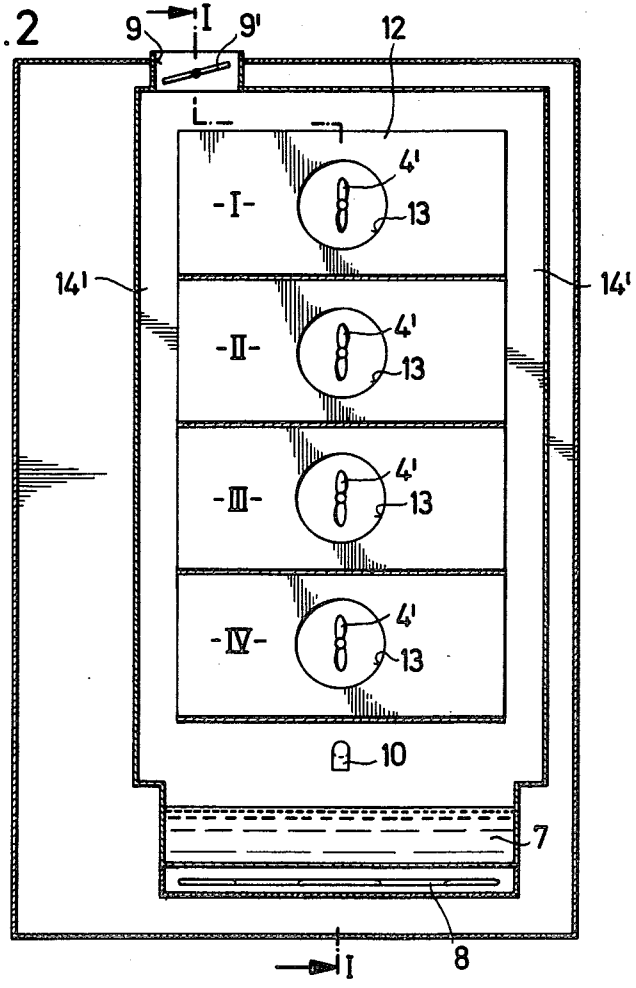
FIG. 2 is a schematic front elevational section of the same embodiment taken along line II—II of FIG. 1.

Turning now to FIG. 1, the apparatus for heating food stuff comprises a treating chamber 1, the frontal charging opening of which can be closed by a door 2 with the interposition of conventional seals 3. The chamber 1 is provided with a shelving including a plurality of superposed shelves I, II, III and IV that can be stacked with food. Preferably at the rear side of the chamber 1, there are provided a plurality of blowers 4 which are driven by respective motors 5 and which are of the radial fan type and are expediently arranged with a vertical spacing of approximately not more than 400 mm. In this manner, during the operation of the blowers 4, several air currents are generated whose course will be described below. Each blower 4 has a conventional tubular heating element 6.

In the bottom zone of the chamber 1 there is provided a water basin 7 equipped with an electric heater 8 for heating the water therein to generate steam. Further, the basin serves as a collecting receptacle for receiving and storing in a protective manner various juices dripping from the food stuff, such as grease, as well as liquids from vegetables or meats. In this manner, these liquid materials are prevented from being scorched. The top of the treating chamber 1 is provided with an opening 9 that can be throttled by means of a gate 9' for controlling the withdrawal of hot air and water vapor from the chamber 1. The basin 7 is supplied with water through a valve-controlled faucet 10. At the bottom of the basin 7 there is provided a drain 11 for the withdrawal of the water.

In front of each blower 4 there is arranged a removable hood 12 which has a central suction opening 13 aligned with the respective blower 4 and which is further provided with lateral openings 14 through which the heated air is driven into lateral shafts 14' in which the respective air currents flow towards the chamber door 2 to be again drawn by the respective blowers through the associated central suction openings 13 after they have flowed through the respective shelf compartment I–IV. Each hood 12 further has webs 15 which separate the impellers 4' of the blowers 4 from one another. In this manner, there is achieved a uniform circulation of the air in the individual shelf compartments I–IV provided with the respective blower 4.

The control and regulation of the heating of the chamber 1 as well as the water in the basin 7, the gate 9', the water inlet 10 and the drainage 11, as well as the rpm of the individual blowers can be effected automatically by a suitable programmed circuit for different types of food stuffs placed in the treating chamber 1.

The apparatus according to the invention is well adapted to perform all known food treating processes, such as drying, heating, regenerating, maintaining in a warm condition, baking, broiling, thawing, toasting, boiling, steaming, stewing, pre-cooking, finish-cooking, and the like, since it may operate with dry hot air as well as with a mixture of air and vapor or only with water vapor.

It is to be understood that the above description of the present invention is susceptible to various modifications, changes and adaptations, and the same are intended to be comprehended within the meaning and range of equivalents of the appended claims.

What is claimed is:

1. In an apparatus for heating food including a treating chamber; a plurality of horizontally oriented, vertically spaced, superposed shelves dividing the treating chamber into compartments and serving for the support of the food to be heated; a plurality of blowers arranged in the treating chamber; and separate heating elements associated with each of the blowers for generating hot air currents; the improvement wherein all said blowers are arranged in a vertically spaced, superposed relationship at one side of said treating chamber; each said compartment having a separate one of said blowers in alignment therewith; the improvement further comprising (a) means defining vertically oriented lateral shafts in said one side of said treating chamber;

(b) a detachable hood arranged at each blower and having a central suction opening aligned with the respective blower and lateral outlet openings; each compartment being in communication with said lateral shafts through the central suction opening and the lateral outlet openings of the respective hood for directing the air currents generated by each blower towards another, opposite side of said treating chamber;

(c) means for driving said blowers independently from one another and with different rpm's;

(d) a bottom zone forming part of said treating chamber and communicating with said lateral shafts;

(e) a basin provided in said bottom zone of said treating chamber;

(f) means for filling said basin with water;

(g) means for draining said basin;

(h) an electric heater arranged in said basin for heating the water contained therein;

(i) a top side forming part of said treating chamber;

(j) means defining an opening in said top side; and (k) a movable throttle flap disposed in said opening for controlling the cross-sectional flow passage area thereof.

2. An apparatus as defined in claim 1, wherein each hood further has a web for separating adjoining blowers from one another.

* * * * *